United States Patent [19]

Aoki

[11] Patent Number: 4,991,270

[45] Date of Patent: Feb. 12, 1991

[54] MAGNETIC LOCK CLOSURE

[75] Inventor: Yoshihiro Aoki, Tokyo, Japan

[73] Assignee: Application Art Laboratories Co., Ltd., Tokyo, Japan

[21] Appl. No.: 291,786

[22] Filed: Dec. 29, 1988

[30] Foreign Application Priority Data

Jan. 27, 1988 [JP] Japan ..... 63-16302

[51] Int. Cl.[5] ..... A44B 21/00

[52] U.S. Cl. ..... 24/303; 292/251.5

[58] Field of Search ..... 24/303, 49 M, 690, 691, 24/696; 248/206.5; 292/251.5; 335/236, 285

[56] References Cited

U.S. PATENT DOCUMENTS

| | | | |
|---|---|---|---|
| 1,193,227 | 9/1916 | Hinchey . | |
| 1,198,227 | 9/1916 | Hinchey . | |
| 2,223,898 | 12/1965 | Bey . | |
| 2,340,781 | 2/1944 | Wagner . | |
| 2,397,931 | 4/1946 | Ellis . | |
| 2,453,021 | 11/1948 | Konelsky . | |
| 2,468,630 | 4/1949 | Huelster | 24/691 |
| 2,475,226 | 7/1949 | Ellis . | |
| 2,521,885 | 9/1950 | Vasquez . | |
| 2,585,714 | 2/1952 | Wrobel et al. . | |
| 2,615,227 | 10/1952 | Hornik . | |
| 2,623,256 | 12/1952 | Feibelman . | |
| 2,627,423 | 2/1953 | Copeman . | |
| 2,637,887 | 5/1953 | Goodman . | |
| 2,654,929 | 10/1953 | Feibelman . | |
| 2,693,654 | 11/1954 | Clark . | |
| 2,698,917 | 1/1955 | Van Urk et al. . | |
| 2,784,757 | 3/1957 | Bosca et al. . | |
| 2,812,203 | 11/1957 | Scholten . | |
| 2,818,655 | 1/1958 | De Gaston . | |
| 2,826,328 | 3/1958 | Moen et al. . | |
| 2,884,698 | 5/1959 | Würsch . | |
| 2,901,278 | 8/1959 | Robinson . | |
| 2,915,681 | 12/1959 | Troy . | |
| 2,954,253 | 9/1960 | Teetor . | |
| 2,954,874 | 10/1960 | Rouse . | |
| 2,970,857 | 2/1961 | Squire . | |
| 2,975,497 | 3/1961 | Budreck . | |
| 3,009,225 | 11/1961 | Budreck . | |
| 3,038,232 | 6/1962 | Wean . | |
| 3,041,697 | 7/1962 | Budreck . | |
| 3,086,268 | 4/1963 | Chaffin . | |
| 3,111,736 | 11/1963 | Budreck . | |
| 3,111,737 | 11/1963 | Heil . | |
| 3,141,214 | 7/1964 | Bey | 24/303 |
| 3,141,216 | 7/1964 | Brett . | |
| 3,171,176 | 3/1965 | Shirley . | |
| 3,264,970 | 8/1966 | Hersh et al. . | |
| 3,269,608 | 8/1966 | Weber III . | |
| 3,277,681 | 10/1966 | Bey . | |
| 3,324,521 | 6/1967 | Humiston . | |
| 3,372,443 | 3/1968 | Daddona . | |
| 3,502,318 | 3/1970 | Merz . | |
| 3,509,734 | 5/1970 | Lederer . | |

(List continued on next page.)

FOREIGN PATENT DOCUMENTS

| | | |
|---|---|---|
| 1711236 | 11/1955 | Fed. Rep. of Germany . |
| 1127509 | 6/1957 | Fed. Rep. of Germany . |
| 1068149 | 10/1959 | Fed. Rep. of Germany . |
| A 27396 | 4/1962 | Fed. Rep. of Germany . |
| 2419407 | 4/1974 | Fed. Rep. of Germany . |
| 1586926 | 3/1970 | France . |
| 44-27953 | 11/1969 | Japan . |
| 47-16812 | 10/1972 | Japan . |
| 155313 | 7/1956 | Sweden . |
| 374845 | 11/1959 | Switzerland . |
| 914208 | 12/1962 | United Kingdom . |
| 1009996 | 11/1965 | United Kingdom . |

*Primary Examiner*—James R. Brittain

*Attorney, Agent, or Firm*—Wenderoth, Lind & Ponack

[57] ABSTRACT

A magnetic lock closure device has a magnetically attracting part and a magnetically attracted part, the magnetically attracting part having an enlarged portion extending outwardly for allowing the magnetically attracted part to engage the magnetically attracting part through the center bore on it by means of the ferromagnetic rods on the two parts, without making any attempt to search for the center bore. Each of the magnetically attracting part and magnetically attracted part includes a fastener for fastening it to the corresponding part of a two-part article such as a bag without increasing the thickness of that part.

5 Claims, 3 Drawing Sheets

U.S. PATENT DOCUMENTS 3,618,174 11/1971 Schainholz et al. .
3,722,360 3/1973 Blakey et al. .
3,895,330 7/1975 Yost .
3,919,743 11/1975 Cuther .
4,021,891 5/1977 Morita .
B1 4,021,891 8/1986 Morita .
B2 4,021,891 9/1987 Morita .
4,453,294 6/1984 Morita .
4,455,719 6/1984 Morita ..... 24/303
4,480,361 11/1984 Morita ..... 24/303
4,527,310 7/1985 Vandebult ..... 24/303 X

MAGNETIC LOCK CLOSURE

BACKGROUND OF THE INVENTION

1. Field of the Invention

The present invention relates generally to a lock closure for articles having two integral but separable parts such as portable bags, handbags, etc., and more particularly to such lock closure using magnetic attraction for coupling those two parts together.

2. Description of the Prior Art

There are various types and kinds of magnetic lock closure devices that use the attraction of a magnet, thereby keeping the articles such as handbags or coats in their closed conditions.

Those magnetic lock closure devices have different constructions depending upon their particular usages. Among others, one typical construction which is well known includes an annular permanent magnet having a central bore through it. Another typical construction includes a disk-like permanent magnet. The annular permanent magnet provides its lines of magnetic force or magnetic flux centered through the bore. The other disk-like permanent magnet provides its lines of magnetic force or magnet flux centered on one side thereof. In either case, it is known that a strong locking or coupling action can be obtained. Thus, they are used in a number of applications. For example, they are shown and described in Japanese design patent No. 5110639.

The prior art constructions that have been mentioned above are designed to provide their centered lines of magnetic force or magnetic flux consist of one part formed by a permanent magnet and which provides the attractive force and the other part usually formed by any suitable magnetically attracted material such as soft iron and which is attracted by the permanent magnet and is removably attached to the magnet. In those applications in which this type of construction is used with an article such as a bag and the like, the one part formed by the permanent magnet is usually rigidly mounted to one part of such article such as its body while the other part formed by the soft iron is usually rigidly mounted to the counterpart of the article such as a flap.

More specifically and typically, the attracting part of the above construction includes a disk-like plate of ferromagnetic material and an annular permanent magnet mounted on the disk-like plate. The disk-like plate and permanent magnet are combined together into a single unit, which is completely enclosed with a nonmagnetic cover. That is, the inner peripheral, upper surface and outer peripheral portions of the permanent magnet are totally covered. The ferromagnetic disk-like plate has a rod at its center which extends upwardly into the central bore through the permanent magnet until it reaches half way up the central bore. The rod is made of a ferromagnetic material. As such, the lines of magnetic force from one pole or N pole of the permanent magnet can enter the rod which contacts that pole, and the most part of the lines of magnetic force or magnetic flux will be centered on the rod, flowing through it toward the side of the opposite polarity or S pole of the magnet. The magnetically-attracted part of the construction consists of a similar disk-like plate of ferromagnetic material which engages the other side or S-pole side of the permanent magnet. The disk-like plate also has a rod at its center which extends upwardly into the central bore through the permanent magnet until it reaches half way and abuts against the first-mentioned rod on the side of the permanent magnet. Thus, the most part of the magnetic flux is also centered on the second-mentioned rod.

When the conventional magnetic lock closure device is used in those or other applications, there is often a problem that may occur when the two parts of the device are to be coupled together. When the part of the device that is magnetically attracted by the other part is to be attached to the other part, an attempt is usually or always made to search for the central bore of the permanent magnet so that the rod on the attracted part can register with the central bore. This attempt is usually made by blind touch rather than visually, and is accompanied by causing that rod to slide on and about the nonmagnetic cover until the central bore can be located. Sometimes, several such attempts may be made until the rod can be aligned with and engage the central bore successfully. During this sliding motion, the rod is receiving the magnetic attraction of the permanent magnet as well as a small amount of magnetic attraction by the cover even if it is nonmagnetic. Thus, the rod is attracted toward the surface of the cover during the sliding motion, which may cause scratches on the surface. Those scratches will increase as more such attempts are made. For example, articles such as bags, etc. carrying the devices are presented on display at a shop, and prospective customers usually try to check to see if a particular article will meet their respective needs. In determining an article of their choice, then, they usually attempt to see how well the device can work. In so doing, scratches may occur as described above, and the article will lose its commercial value. More opportunities of causing such scratches may occur as more prospective customers are involved.

Each of the attracting part and attracted part of the device has a fastening part formed like a pair of legs which allows the respective part to be fixed to the corresponding part of the bag, such as the body or flap. The use of this fastening part makes the portion of the body or flap where it is mounted thicker. For the flap, which is visible from the outside, the appearance or outlook of the article as a whole may be affected by the presence of the thicker portion.

SUMMARY OF THE INVENTION

One object of the present invention is to provide a magnetic lock closure device that includes a magnetically attracting part with a concave surface and a magnetically attracted part with a convex surface. Those surfaces are so formed on the side, respectively, on which the two parts meet each other.

According to one preferred form of the present invention, the magnetic lock closure device includes a magnetically attracting part and a magnetically attracted part. The magnetically attracting part includes a disk-like plate which is made of any suitable ferromagnetic material, an annular permanent magnet which is placed on the disk-like plate, and an annular member made of any suitable ferromagnetic material which is placed on the permanent magnet. The annular member has a funnel-like form having an outwardly enlarged portion and a narrow portion. The disk-like plate, annular permanent magnet, and annular member are all enclosed in a nonmagnetic cover. The annular permanent magnet has a central bore, and the disk-like plate has an integral ferromagnetic rod at the center extending upwardly half way into the bore through the permanent magnet. The base portion of the rod that extends downwardly through the disk-like plate holds a fastening member which consists of a traverse part and a pair of legs. The magnetically attracted part includes a disk-like plate which is made of any suitable ferromagnetic material, the disk-like plate having a protruded surface on one side thereof and a depressed surface on the other side. It has a rod of any suitable ferromagnetic material extending downwardly so that it can enter half way into the bore through the permanent magnet and abut the counterpart rod of the magnetically attracting part when the two parts are to be coupled together. The base portion of the rod that extends upwardly through the disk-like plate holds a fastening member which consists of a traverse part and a pair of legs.

It should be understood that the ferromagnetic annular member having the funnel shape may be formed to provide the outwardly enlarged portion having a straight surface or curved surface, and the respective portions of the cover and disk-like plate that correspond to the enlarged portion of the annular member may also be formed similarly.

When an attempt is made to couple the magnetically attracting part and magnetically attracted part together, it may be accomplished simply by placing the latter upon the former. As the magnetically attracting part having the concavely formed surface serves as a guide, the magnetically attracted part having the convexly formed surface will be guided toward the central bore of the permanent magnet along the concavely formed surface, without any blind-touch attempt to search for the central bore. It will be appreciated that the two parts can be coupled together successfully with minimum efforts, or with a minimum amount of sliding motion. Any possible damages or scratches that may result from the sliding motion can be minimized.

It will also be appreciated that the fastening member having the pair of legs on the magnetically attracted part may be accommodated within the depressed side of the disk-like plate, which can effectively reduce the thickness of the fastening member that would otherwise be produced when it is fixed to the corresponding part of a particular article such as a bag.

BRIEF DESCRIPTION OF DRAWINGS

Those and other objects, features, and advantages of the present invention will be understood from the following description of several specific preferred embodiments thereof which will be presented by referring to the accompanying drawings, in which.

DETAILED DESCRIPTION OF PREFERRED EMBODIMENTS

Referring to the accompanying drawings, one typical embodiment of the present invention is now described.

Figure 1:
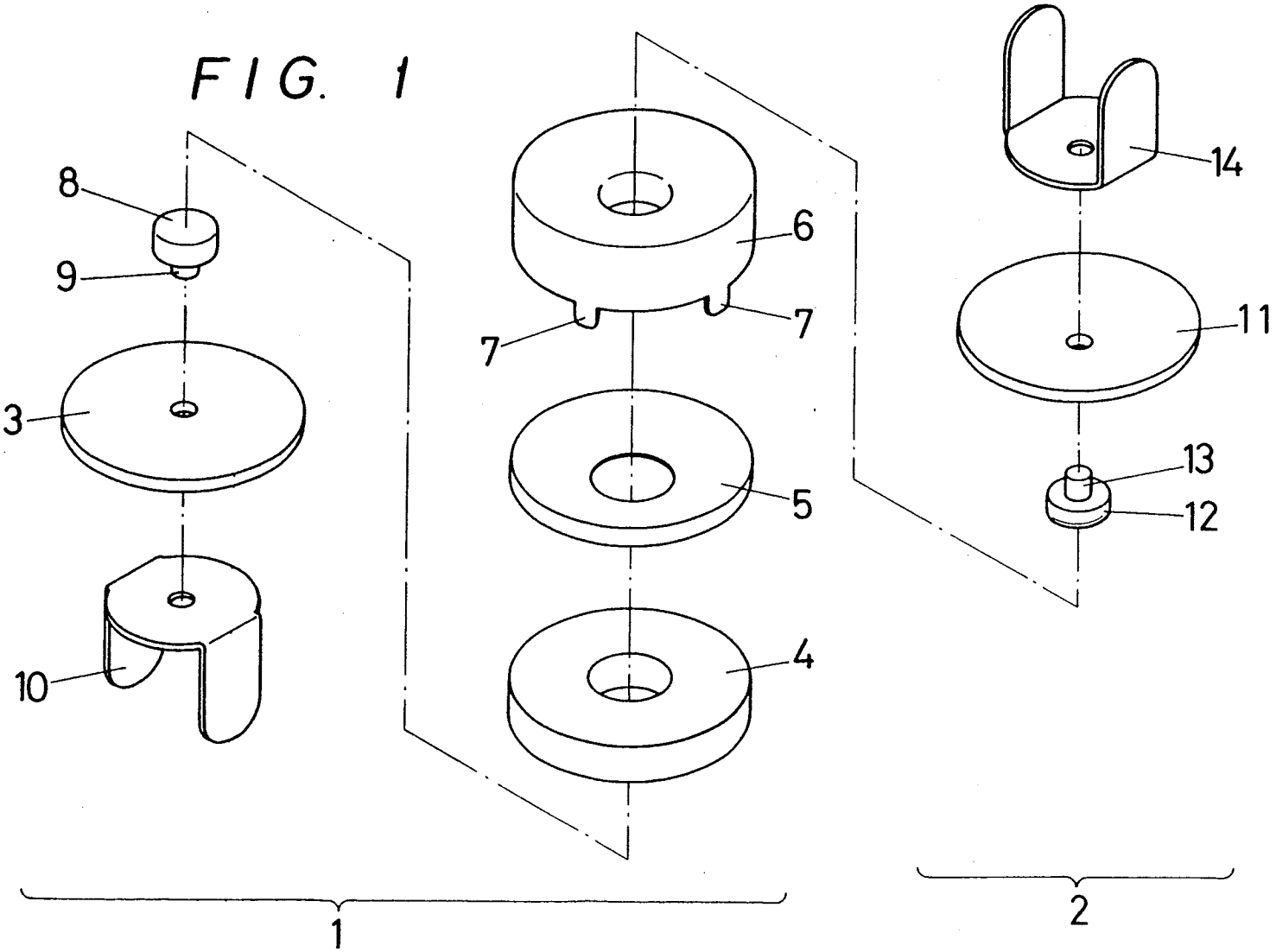
FIG. 1 is an exploded perspective view of the elements comprising the device according to one preferred embodiment of the present invention.
Figure 2:
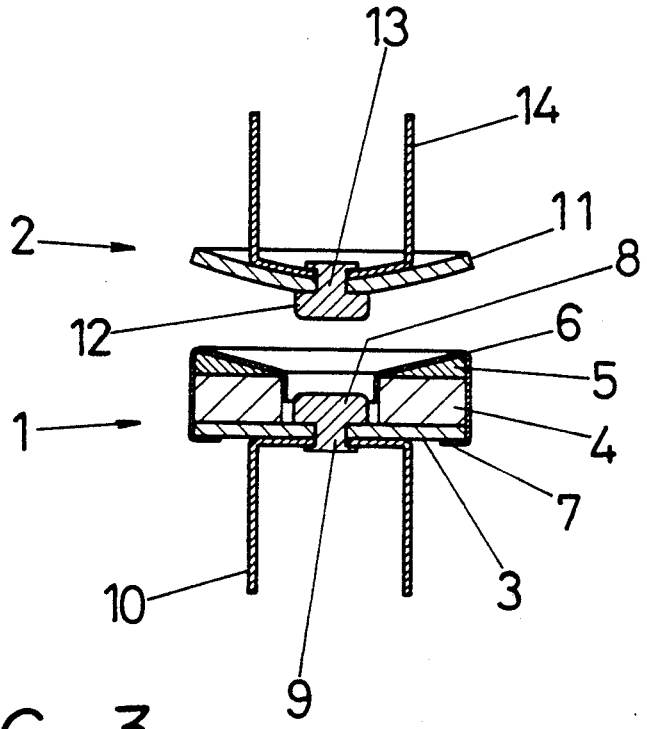
FIG. 2 is a sectional view of the embodiment shown in FIG. 1 in the assembled condition.

In FIGS. 1 and 2, there is a magnetic lock closure device which consists essentially of a magnetically attracting part or first part 1 and a magnetically attracted part or second part 2. The first part 1 includes a disk-like plate 3 made of any suitable ferromagnetic material, an annular permanent magnet 4 placed on the disk-like plate 3 and having a central bore extending through it, and an annular member 5 made of any suitable ferromagnetic material and having a funnel-like shape having an outwardly enlarged portion and a narrow portion. The disk-like plate 3, permanent magnet 4 and annular member 5 are combined together into a single unit, which is completely enclosed in a nonmagnetic cover 6. The nonmagnetic cover 6 encloses the unit in the manner that it covers the inner peripheral wall of the bore through the permanent magnet 4 half way down through the bore, and covers the upper side and outer peripheral side of the annular member 5 and the outer peripheral sides of the permanent magnet 4 and disk-like plate 3. The cover 6 has a plurality of lugs 7 spaced at regular intervals and extending inwardly from the bottom side thereof. Those lugs 7 engage the bottom side of the disk-like plate 3, thereby securing the cover 6 to the assembly unit. The disk-like plate 3 has a rod 8 of any suitable ferromagetic material extending upwardly half way into the bore through the permanent magnet 4, as viewed in FIG. 2. The rod 8 has a base portion 9 extending downwardly through the disk-like plate 3 as viewed in FIG. 2. A fastening member 10 is firmly held by the base portion 9 of the rod 8 which is riveted to the disk-like plate 3. The fastening member 10 includes a transverse part and a pair of legs.

The magnetically attracted part or second part 2 includes a disk-like plate 11 having an outwardly protruding or convex surface on one side (lower side) and a depressed or concave surface on the other side (upper side). The disk-like plate 11 has a rod 12 of any suitable ferromagnetic material extending downwardly as viewed in FIG. 2. The rod 12 has a length sufficient to allow it to enter half way into the bore through the permanent magnet and meet the counterpart rod 8 on the first part 1 when the first and second parts are to be coupled together. Similarly to the rod 8, the rod 12 has a base portion 13 extending upwardly through the disk-like plate 11 as viewed in FIG. 2. A fastening member 14 is firmly held by the base portion 12 of the rod 12 which is riveted to the disk-like plate 11. The fastening member 14 includes a transverse part and a pair of legs. Specifically, iron or soft iron may be used as a suitable ferromagnetic material for the disk-like plates 3, 11 and the annular member 5, and brass may be used as a suitable nonmagnetic material for the cover 6.

The device of the invention that has been described may be used with an article such as a bag, as is the case with the conventional prior art device. In this case, the magnetically attracting part or first part 1 may be attached to the body of the bag, and the magnetically attracted part or second part 2 may be attached to the flap of the bag. This attachment may be accomplished by inserting the pair of legs of the fastening member 10 or 14 into the corresponding part of the bag and then folding the legs as shown.

When the first and second parts 1 and 2 are to be coupled together, the second part 2 is first brought closer to the first part 1. Then, the rod 12 on the second part 2 is made to contact any area on the funnel-shaped surface which is enveloped by the cover 6, and is then guided along the inwardly inclined surface directly toward the center bore through the permanent magnet 4. Thus, the rod 12 is accepted by the bore, entering the bore until it engages the rod 8 on the first part 1. This means that the first and second parts can be coupled together under the action of the magnetic attraction, as the rod 12 can be guided toward the center bore immediately upon contact with the funnel-shaped surface. This eliminates the attempt to search for the center bore that would otherwise cause scratches on the cover 6 due to the sliding action of the rod 12.

Figure 3:
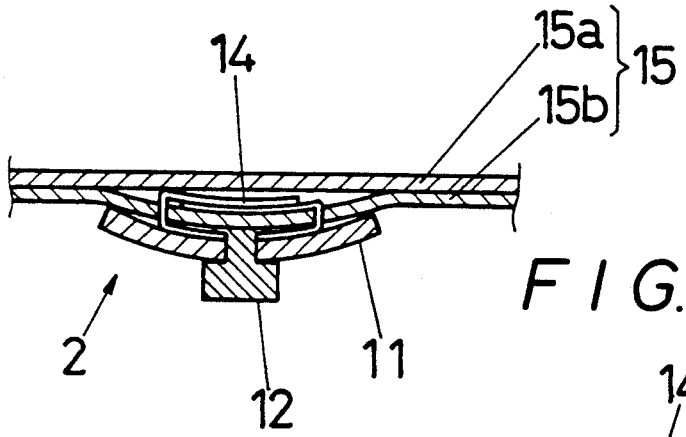
FIG. 3 is a sectional view of the magnetically attracted part of the device, illustrating how the component elements are assembled together.

Referring next to FIG. 3, there is shown the second part 2 fastened to the flap 15 of the bag. In the example shown, the flap 15 consists of two layers of sheets of cloth or leather, for example, such as the outer layer 15*a* and inner layer 15*b*. The fastening member 14 has its pair of legs passed through the inner layer 15*b* and folded over it.

Figure 4:
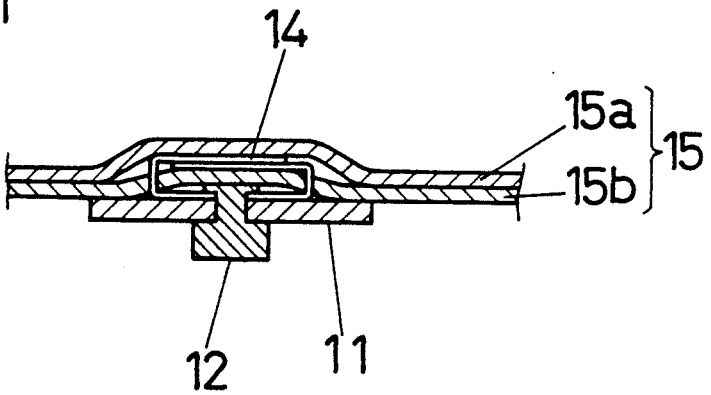
FIG. 4 is a sectional view of the corresponding magnetically attracted part of a typical conventional device, illustrating how those component elements are assembled as compared with the device of the present invention.

With the conventional device shown in FIG. 4, the outer layer 15*a* is usually raised outwardly by those folds, while for the device of the present invention, the folds may be accommodated within the depressed side of the disk-like plate 11. Thus, the outer layer 15*a* will not be raised outwardly by the folds.

Figure 5:
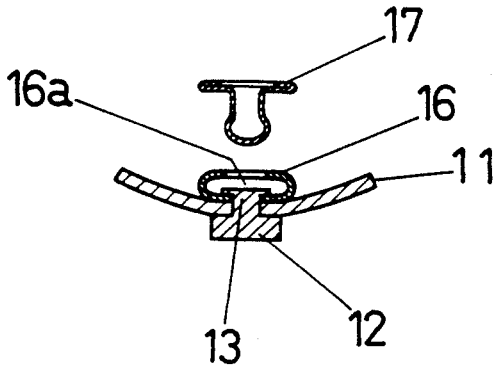
FIG. 5 is a section view of a variation of the fastening member provided for the device in the preceding embodiment.
Figure 6:
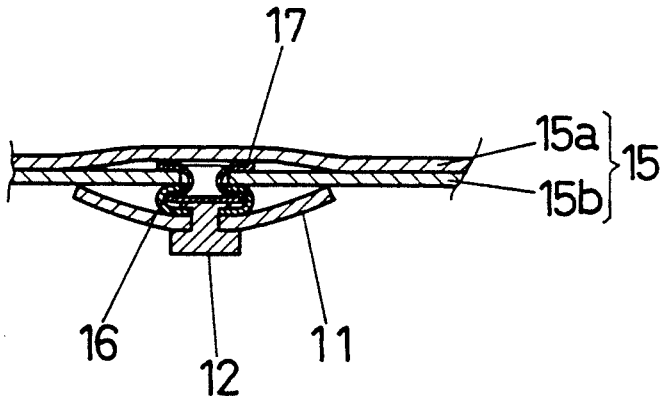
FIG. 6 is a sectional view of the variation in FIG. 5, illustrating how it is fastened to the corresponding part or flap of an article such as a bag.

FIGS. 5 through 8 illustrate variations of the fastening member 14. Referring to FIGS. 5 and 6, there is a first variation of the fastening member, which includes a bag-like member 16 having a round shape in plan and which is hollow inside as shown as 16*a*. It is firmly held by the base portion 13 of the rod 12 at the center of the depressed side of the disk-like plate 11. In this variation, a fastening part which allows the first or second part 1 or 2 to be fastened to the corresponding part of the article is provided separately. This fastening part 17 has the equivalent function of the pair of legs in the preceding embodiment, except that it has a bulb portion that can engage the member 16 and an annular plate portion that can be secured to the inner layer 15*b*. The member 16 and fastening part 17 thus combined can be accommodated within the depressed side of the disk-like plate 11 as described in the preceding embodiment.

Figure 7:
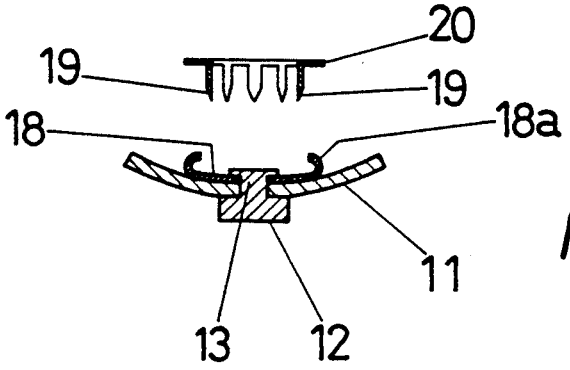
FIG. 7 is a sectional view of another variation of the fastening member.
Figure 8:
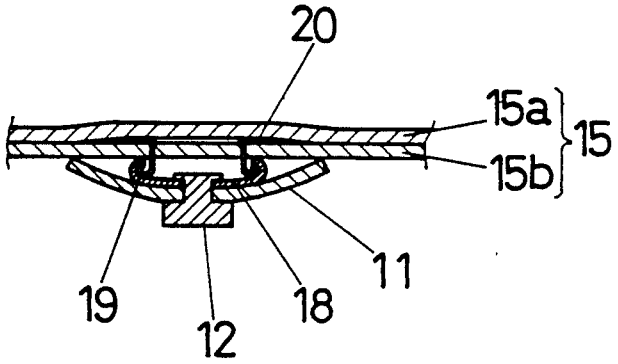
FIG. 8 is a sectional view of the variation in FIG. 7, illustrating how it is fastened to the corresponding part or flap of an article such as a bag.

Referring to FIGS. 7 and 8, there is another variation which includes a fastening member 18 having a round shape in plan and having a marginal edge 18*a* curled inwardly. Similarly to the preceding embodiment and variation, the fastening member 18 is firmly held by the base portion 13 of the rod 12 at the center of the depressed side of the disk-like plate 11. A fastening part 20 is provided separately which has spear-headed members 19 extending downwardly as viewed in FIG. 7 which can engage the marginal edge 18*a* of the fastening member 18 through the inner layer 15*b*. Specifically, the fastening member 18 and fastening part 20 can be combined by curling the spear-headed members 19 inside the curled marginal edge 18*a* of the fastening member 18. The fastening member 18 and fastening part 20 thus combined can be accommodated within the depressed side of the disk-like plate 11 as shown in FIG. 8.

The device according to the present invention advantageously minimizes any possible damages or scratches that may occur on the nonmagnetic cover which encloses the magnetically attracting part. It also advantageously eliminates or reduces substantially the thickness that is produced by securing the fastening member to the corresponding part of an article such as bags, handbags, etc. As a result, such articles can retain their good appearance and commercial value as goods. It is no longer necessary to attempt to search for the center bore when the two parts of the device are to be coupled together, since the rod on the magnetically attracted part can be guided along the inclined surface of the magnetically attracting part toward its center bore. This effectively helps reduce the amount of scratches.

Although the present invention has been described by referring to the particular preferred embodiments thereof, it should be understood that various changes and modifications may be made without departing from the scope and spirit of the invention.

What is claimed is:

1. A magnetic lock closure device comprising first means for providing a magnetic attracting action and second means for being magnetically attracted by the first means, the first means having a first disk-like plate of a ferromagnetic material and a uniform-thickness annular permanent magnet having a central bore therethrough and placed on the first disk-like plate, the first disk-like plate having a first ferromagnetic rod at the center extending partially into the central bore through the permanent magnet and the second means having a second disk-like plate of a ferromagnetic material having a second ferromagnetic rod at the center extending partially into the central bore through the permanent magnet when the first and second means are to be coupled together, wherein said first means includes:

an annular ferromagnetic member having an inner surface in full contact with said annular permanent magnet and having a central bore connected to the central bore of the permanent magnet and having an increasing thickness in the direction extending outwardly from said central bore of said annular ferromagnetic member only to the outer peripheral edge of said annular permanent magnet to form a concave outer surface on the side remote from said permanent magnet;

said first ferromagnetic rod including a first base portion extending through said first disk-like plate;

first fastening means firmly held by said first base portion of said first ferromagnetic rod; and nonmagnetic means for enveloping the peripheral edges of said first ferromagnetic disk-like plate, and said annular permanent magnet and the peripheral edge and concave surface of said annular ferromagnetic member; and wherein the second means further includes:

said second disk-like plate having an outwardly protruding surface on one side thereof and a depressed surface on the other side, said outwardly protruding surface being complementary in shape to and adapted to engage said nonmagnetic means covering the concave surface of said annular ferromagnetic member on said permanent magnet when said first and second means are to be coupled together;

said second ferromagnetic rod extending from said outwardly protruding surface of said second disk-like plate and including a second base portion extending through said second disk-like plate; and second fastening means firmly held by said second base portion of said second ferromagnetic rod.

2. A lock closure device as defined in claim 1, wherein said concave outer surface of said annular ferromagnetic member is a straight or curved surface.

3. A magnetic lock closure device as defined in claim 1, wherein said first fastening means includes a first transverse portion firmly held by said first base portion of said first ferromagnetic rod and a pair of legs extending from said first transverse portion, and wherein said second fastening means includes a second transverse portion firmly held by said second base portion of said second ferromagnetic rod and a pair of legs extending from said second portion.

4. A magnetic lock closure device as defined in claim 1, wherein said first fastening means includes a first hollow bag-like member firmly held by said base portion of said first ferromagnetic rod and a first fastening member adapted to be accepted by said hollow bag-like member, and wherein said second fastening means includes a second hollow bag-like member firmly held by said second base portion of said second ferromagnetic rod and a second fastening member adapted to be accepted by said second hollow bag-like member.

5. A magnetic lock closure device as defined in claim 1, wherein said first fastening means includes a first member having a first annular marginal edge and firmly held by said first base portion of said ferromagnetic rod and a first fastening member having a plurality of spear-headed members extending therefrom and adapted to engage said first annular marginal edge, and wherein said second fastening means includes a second member having a second annular marginal edge and firmly held by said second base portion of said second ferromagnetic rod and a second fastening member having a plurality of spear-headed members extending therefrom and adapted to engage said second annular marginal edge.

* * * * *